US009616273B2

(12) United States Patent
Chen

(10) Patent No.: US 9,616,273 B2
(45) Date of Patent: Apr. 11, 2017

(54) ADJUSTABLE DUMBBELL ASSEMBLY

(71) Applicant: Paul Chen, Vancouver (CA)

(72) Inventor: Paul Chen, Vancouver (CA)

( * ) Notice: Subject to any disclaimer, the term of this patent is extended or adjusted under 35 U.S.C. 154(b) by 35 days.

(21) Appl. No.: 14/849,787

(22) Filed: Sep. 10, 2015

(65) Prior Publication Data

US 2017/0072243 A1 Mar. 16, 2017

(51) Int. Cl.

*A63B 21/072* (2006.01)
*A63B 21/075* (2006.01)
*A63B 21/06* (2006.01)

(52) U.S. Cl.

CPC ..... *A63B 21/075* (2013.01); *A63B 21/0726* (2013.01); *A63B 21/0728* (2013.01); *A63B 21/072* (2013.01)

(58) Field of Classification Search

CPC ..... A63B 1/00; A63B 1/005; A63B 17/00; A63B 17/02; A63B 17/04; A63B 21/00; A63B 21/0004; A63B 21/00058; A63B 21/00061; A63B 21/00065; A63B 21/0069; A63B 21/00072; A63B 21/00076; A63B 21/06; A63B 21/072; A63B 21/0722; A63B 21/0724; A63B 21/0726; A63B 21/0728; A63B 21/075; A63B 21/4043

See application file for complete search history.

(56) References Cited

U.S. PATENT DOCUMENTS

| | | | | |
|---|---|---|---|---|
| 5,407,413 | A | 4/1995 | Kupferman | |
| 5,839,997 | A | 11/1998 | Roth et al. | |
| 6,656,093 | B2 | 12/2003 | Chen | |
| 7,223,214 | B2 * | 5/2007 | Chen | A63B 21/063 482/107 |
| 7,413,533 | B2 * | 8/2008 | Lin | A63B 21/075 482/106 |
| 7,604,577 | B2 * | 10/2009 | Lin | A63B 21/075 482/106 |
| 7,731,641 | B1 | 6/2010 | Chen | |
| 7,811,213 | B2 | 10/2010 | Chen | |
| 7,887,469 | B1 * | 2/2011 | Chen | A63B 21/0728 482/107 |
| 8,932,188 | B2 * | 1/2015 | Svenberg | A63B 21/075 482/106 |
| 2004/0005969 | A1 * | 1/2004 | Chen | A63B 21/063 482/107 |
| 2007/0184945 | A1 * | 8/2007 | Lin | A63B 21/075 482/107 |

* cited by examiner

*Primary Examiner* — Joshua Lee
(74) *Attorney, Agent, or Firm* — Charles E. Baxley

(57) ABSTRACT

An adjustable dumbbell device includes a handle bar having two plates extended from end portions and two extensions, a number of weight members each having a groove and a passage, two blocks are secured to the extensions, two pairs of beams are secured between the plates and the blocks and engageable into the groove of the weight member, two latches are slidably engaged onto the extensions, two rods are secured to the latches for moving the latches relative to the beams, two catches are engaged onto the rods and biased to engage with the beams, and two weight elements are detachably attached to the blocks, the weight elements each has a weight of one half (½) of that of the weight member.

7 Claims, 2 Drawing Sheets

ADJUSTABLE DUMBBELL ASSEMBLY

BACKGROUND OF THE INVENTION

1. Field of the Invention

The present invention relates to an adjustable dumbbell, and more particularly to an adjustable dumbbell assembly having an additional weight element for adjusting the weight for the adjustable dumbbell.

2. Description of the Prior Art

Various kinds of typical adjustable dumbbells have been developed and provided for conducting various exercise operations, for example, U.S. Pat. No. 5,407,413 to Kupferman, U.S. Pat. No. 5,839,997 to Roth et al., U.S. Pat. No. 6,656,093 to Chen, U.S. Pat. No. 7,223,214 to Chen, U.S. Pat. No. 7,731,641 to Chen, U.S. Pat. No. 7,811,213 to Chen, and U.S. Pat. No. 7,887,469 to Chen disclose several of the typical adjustable dumbbells each including a number of weight rings or weight members that may be selectively or adjustably secured together for adjusting the weight of the dumbbells.

Normally, in the typical adjustable dumbbells, two or more pairs of weight members are provided for attaching to the end portions of the central handle bar, and for balancing purposes, the weight rings or weight members are attached to the end portions of the central handle bar in pair, and may not be selectively or adjustably secured to the central handle bar with a weight ring or weight member having a decreased weight.

However, the weight members are required to be attached to the end portions of the central handle bar in pair, and the total weight of the weight members attached to the central handle bar may not be micro-adjusted.

The present invention has arisen to mitigate and/or obviate the afore-described disadvantages of the conventional adjustable dumbbells.

SUMMARY OF THE INVENTION

The primary objective of the present invention is to provide an adjustable dumbbell assembly including an additional weight element for micro adjusting the total weight for the adjustable dumbbell.

In accordance with one aspect of the invention, there is provided an adjustable dumbbell assembly comprising a handle bar including two end portions, two plates extended radially and outwardly from the end portions of the handle bar respectively, the plates each including a bore formed therein, a number of weight members each including a groove formed therein and having an open top, and each including a passage formed in the weight member and communicating with the groove of the weight member, the passage of the weight member including a diameter greater than a width of the groove of the weight member, the handle bar including two extensions extended from the end portions of the handle bar respectively and extended through the bores of the plates respectively, two blocks secured to the extensions of the handle bar respectively, two pairs of beams secured and retained between the plate and the block at the end portions of the handle bar respectively, and engageable into the groove of the weight member from the open top of the weight member respectively, the pairs of beams each including a number of slots formed therein and defined by a number of projections for engaging with the weight members and for positioning and retaining the weight members to the beams and for preventing the weight members from moving axially relative to the beams, two latches slidably engaged onto the extensions of the handle bar and engageable into the bores of the plates respectively, and slidable between the pair of beams, two rods secured to the latches respectively for moving the latches relative to the beams and the extensions of the handle bars respectively, two catches slidably engaged onto the rods respectively and biased to engage with the beams by spring biasing members respectively, and two weight elements detachably attached to the blocks respectively, the weight elements each including a weight of one half (½) of that of the weight member.

The weight elements each include a chamber formed therein for engaging with the block. The blocks each include two cavities formed therein for engaging with the pair of beams. The plates each include two orifices formed therein for engaging with the pair of beams. The pair of beams each include a guide channel formed therein for slidably engaging with the rods respectively.

The blocks are each secured to the extension of the handle bar with a fastener, and the weight elements are each secured to the fastener. The fasteners each include a screw hole formed therein, and the weight elements each include a threaded shank for engaging with the screw hole of the fastener and for securing the weight elements to the extensions of the handle bar.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
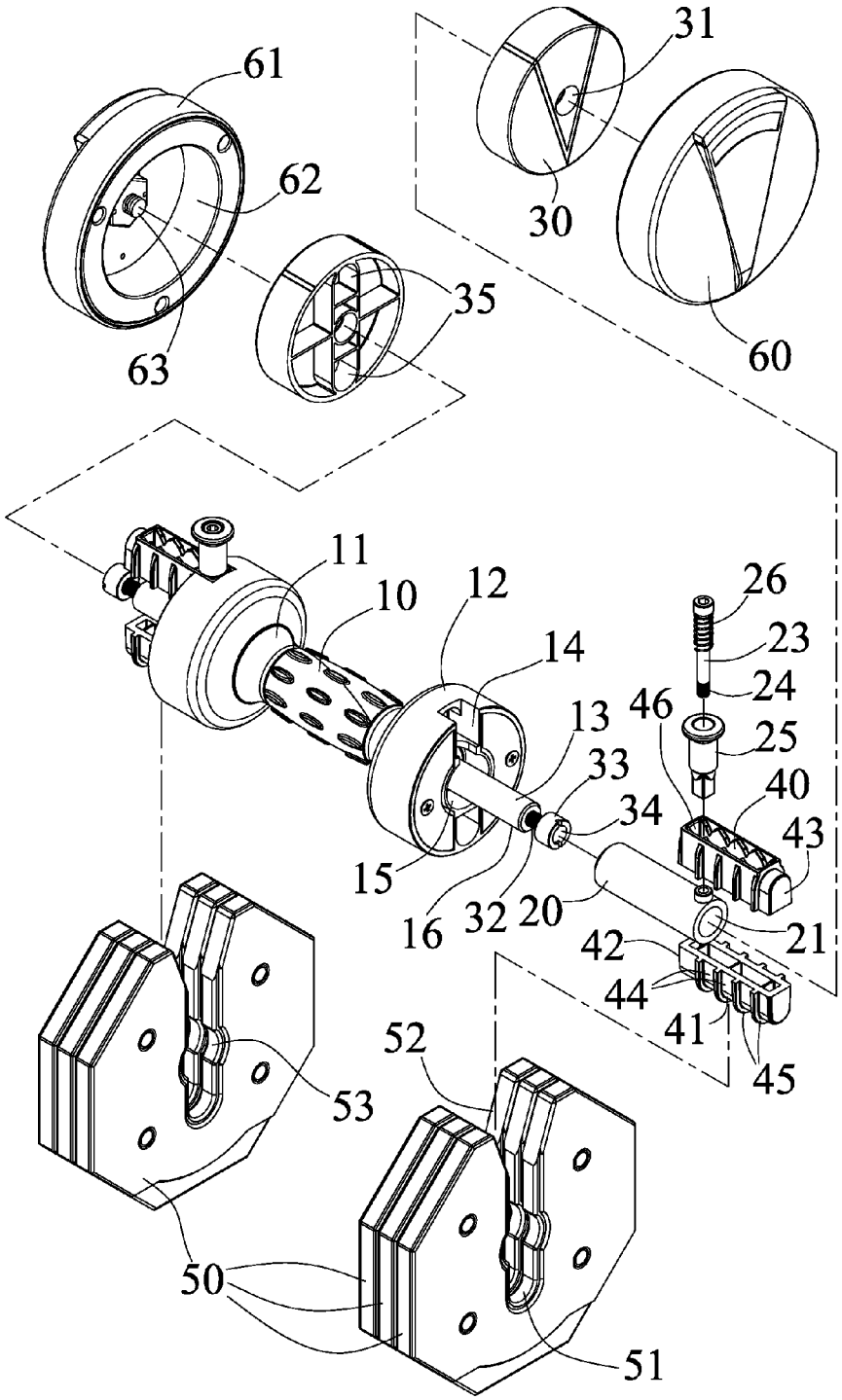
FIG. 1 is a partial exploded view of an adjustable dumbbell assembly in accordance with the present invention.
Figure 2:
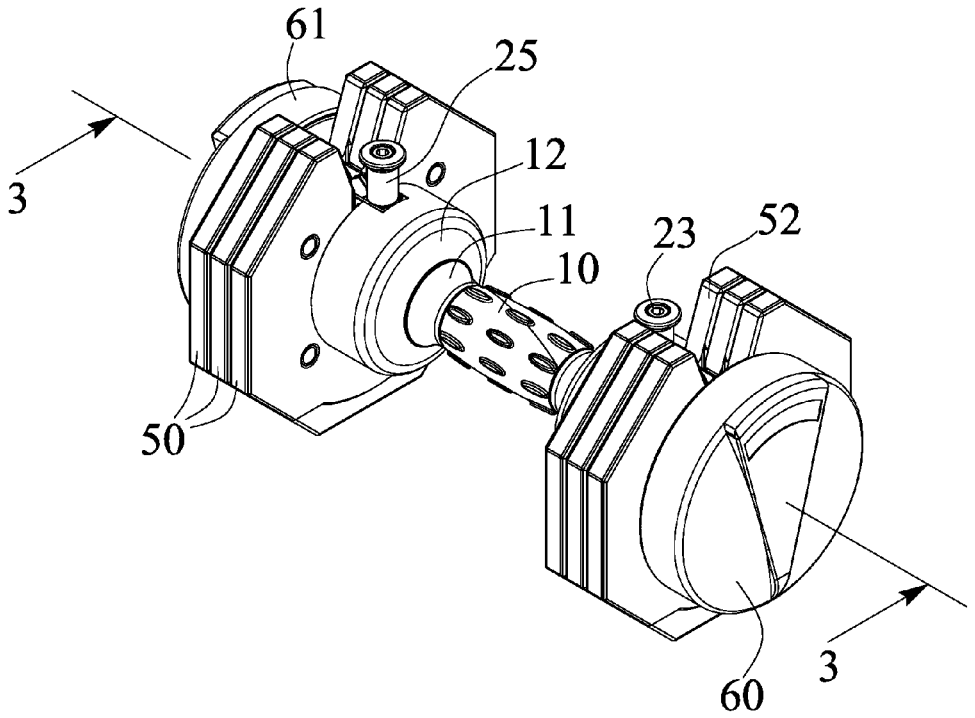
FIG. 2 is a perspective view of the adjustable dumbbell assembly.

Referring to the drawings, and initially to FIGS. 1 and 2, an adjustable dumbbell assembly in accordance with the present invention comprises a central handle bar 10, and a number of weights 50, such as weight rings or plates or members 50 to be detachably or changeably or removably attached or mounted secured to the central handle bar 10, and to be easily and quickly adjusted to different weights for the adjustable dumbbell assembly. The weight members 50 each include a groove 51, such as a vertical groove 51 formed therein and having an open top 52, and each include a lateral passage 53 formed therein and communicating with or intersecting with the vertical groove 51 thereof. The lateral passage 53 of the weight member 50 includes a width or an inner diameter greater than the width of the groove 51 of the weight member 50.

The handle bar 10 includes two end portions 11 each having a plate 12 extended radially and outwardly therefrom, and each having an extension 13 extended laterally or axially and outwardly therefrom, and each of the plates 12 include one or more (such as two opposite) notches or orifices 14 formed therein, the handle bar 10 and/or the plates 12 include a bore 15 formed therein and communicating with the orifices 14 of the plates 12. The extensions 13 of the handle bar 10 are extended through the bore 15 of the plates 12 respectively. Two cylindrical latches 20 are slidably engaged onto the extensions 13 of the handle bar 10 respectively, and engageable into the bore 15 of the plates 12 and/or of the handle bar 10. Each of the cylindrical latches 20 include an elongated or longitudinal hole 21 formed therein to slidably receive the extensions 13 of the handle bar 10 respectively.

Two blocks 30 each include a stepped hole 31 formed in the center portion thereof to slidably receive the free end portion 16 of the extension 13 of the handle bar 10 respectively, and a fastener 32 includes an enlarged head 33 engaged with the stepped hole 31 of the respective block 30, and the fasteners 32 are threaded to or engaged with the free end portions 16 of the extensions 13 of the handle bar 10 respectively to detachably secure the blocks 30 to the extensions 13 of the handle bar 10. The fasteners 32 each include a screw hole 34 formed in the head 33. Each of the blocks 30 include one or more (such as two opposite) cavities 35 formed therein. It is preferable that the cavities 35 are oppositely formed in the respective block 30, and preferably provided or positioned on the opposite sides of the hole 31 thereof.

Two first beams 40, 41 are provided on each of the end portions 11 of the handle bar 10, or on each of the plates 12, and arranged parallel to the extensions 13 of the handle bar 10, and the first beams 40, 41 each include one or first end 42 received and/or engaged in or secured in the orifices 14 of the respective plate 12, and each include the other or second end 43 received and/or engaged in or secured in the cavities 35 of the respective block 30 for allowing the beams 40, 41 to be solidly secured and retained between the plate 12 and the block 30 at one end of the handle bar 10. Similarly, two second beams 40, 41 may also be solidly secured and retained between the plate 12 and the block 30 at the other end of the handle bar 10. It is to be noted that the beams 40, 41 may also be formed integral with the plates 12 and the blocks 30.

The extensions 13 of the handle bar 10 may thus be provided or extended between the beams 40, 41, and preferably include an outer diameter or a width no greater than the width of the beams 40, 41 respectively, such that the beams 40, 41 and the extensions 13 of the handle bar 10 may be moved into or through the grooves 51 of the weight members 50 respectively from the open top 52 of the weight members 50 respectively. The beams 40, 41 each include one or more slots 44 formed therein and defined by one or more projections 45 for engaging with the weight members 50 and for positioning and retaining the weight members 50 to the beams 40, 41, and for preventing the weight members 50 from moving laterally or axially relative to the beams 40, 41 and the handle bar 10. The beams 40, 41 each include a guide channel 46 formed therein.

The cylindrical latches 20 are slidably engaged between the extensions 13 of the handle bar 10 and the beams 40, 41 respectively, and slidably receivable or engageable in the passages 53 of the weight members 50 respectively, and include an outer diameter greater than the width of the grooves 51 of the weight members 50, in order to selectively anchor and latch and secure the weight members 50 to the beams 40, 41 and/or the extensions 13 of the handle bar 10. It is to be noted that the latches 20 may be selectively or adjustably engaged with the selected number of weight members 50 for anchoring and latching and securing the selected number of weight members 50 to the beams 40, 41 and/or the extensions 13 of the handle bar 10.

Two rods 23 are secured to the cylindrical latches 20 respectively, or each include a threaded portion 24 threaded and secured to the latches 20 respectively, and the rods 23 will thus be moved in concert with the cylindrical latches 20 respectively. Two catches 25 are slidably engaged onto the rods 23 respectively and biased to engage with the beams 40 by spring biasing members 26, for example. The rods 23 are slidably engaged in the guide channels 46 of the beams 40 respectively, and may be moved along the beams 40 and/or the end portions 11 or the extensions 13 of the handle bars 10 respectively, in order to move the latches 20 along the end portions 11 of the handle bars 10 respectively, and so as to engage the latches 20 into the passages 53 of the required number of weight members 50.

Figure 3:
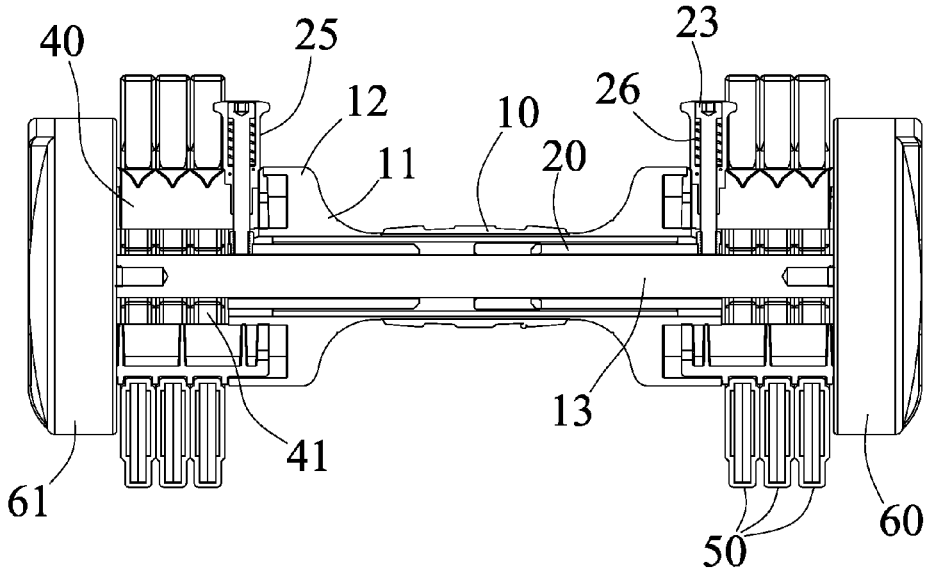
FIG. 3 is a cross sectional view of the adjustable dumbbell assembly, taken along lines 3-3 of FIG. 2.

For example, as shown in FIG. 3, the latches 20 may be moved along the extensions 13 of the handle bars 10 and may be engaged into the passages 53 of the selected number of weight members 50 respectively for anchoring and latching and securing the selected number of weight members 50 to the beams 40, 41 and/or the extensions 13 of the handle bar 10. However, it is to be noted that the weight members 50 are normally required to be attached to the end portions 11 of the central handle bar 10 in pair, and if the weight members 50 each include a weight of one (1) kg, there will be (two) 2 kgs, 4 kgs, 6 kgs . . . of the weight members 50 attached to the central handle bar 10. The user may not selectively or adjustably attach or secure (one) 1 kg, or 0.5 kg to the central handle bar 10; i.e., the total weight of the weight members 50 attached to the central handle bar 10 may not be micro-adjusted.

Accordingly, the adjustable dumbbell assembly in accordance with the present invention further includes one or more (such as two) weight elements 60, 61 to be selectively or adjustably attached or mounted or secured or engaged onto the blocks 30 and/or the plates 12 and/or the end portions 11 of the handle bar 10. For example, the weight elements 60, 61 each include a weight of about one half (½) of that of the weight member 50, such as 0.5 kg, and each include a compartment or chamber 62 formed therein for receiving or engaging with the respective block 30, and each include a threaded shank 63 for threading or engaging with the screw hole 34 of the head 33 of the fastener 32 and for detachably attaching or mounting or securing to the blocks 30 and/or the end portions 11 of the handle bar 10.

In operation, as shown in FIGS. 1-3, the selected number of weight members 50 may be selectively or adjustably secured to the central handle bar 10 with the latches 20. In addition, the weight elements 60, 61 that include a weight of about one half (½) of that of the weight member 50 may also be selectively or adjustably secured to the central handle bar 10 with the blocks 30, for allowing the user to be selectively or adjustably attach or secure the weight member 50 and/or the weight elements 60, 61 to the central handle bar 10.

Accordingly, the adjustable dumbbell assembly in accordance with the present invention includes an additional weight element for adjusting the weight for the adjustable dumbbell.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An adjustable dumbbell assembly comprising:

a handle bar including two end portions, two plates extended radially and outwardly from said end portions of said handle bar respectively, said plates each including a bore formed therein, a plurality of weight members each including a groove formed therein and having an open top, and each including a passage formed in said weight member and communicating with said groove of said weight member, said passage of said weight member including a diameter greater than a width of said groove of said weight member, said handle bar including two extensions extended from said end portions of said handle bar respectively and extended through said bores of said plates respectively, two blocks secured to said extensions of said handle bar respectively, two pairs of beams secured and retained between said plate and said block at said end portions of said handle bar respectively, and engageable into said groove of said weight member from said open top of said weight member respectively, said pairs of beams each including a plurality of slots formed therein and defined by a plurality of projections for engaging with said weight members and for positioning and retaining said weight members to said beams and for preventing said weight members from moving axially relative to said beams, two latches slidably engaged onto said extensions of said handle bar and engageable into said bores of said plates respectively, and slidable between said pair of beams, two rods secured to said latches respectively for moving said latches relative to said beams and said extensions of said handle bars respectively, two catches slidably engaged onto said rods respectively and biased to engage with said beams by spring biasing members respectively, and two weight elements detachably attached to said blocks respectively, said weight elements each including a weight of one half (½) of that of said weight member.

2. The adjustable dumbbell assembly as claimed in claim 1, wherein said weight elements each include a chamber formed therein for engaging with said block.

3. The adjustable dumbbell assembly as claimed in claim 1, wherein said blocks are each secured to said extension of said handle bar with a fastener, and said weight elements are each secured to said fastener.

4. The adjustable dumbbell assembly as claimed in claim 3, wherein said fasteners each include a screw hole formed therein, and said weight elements each include a threaded shank for engaging with said screw hole of said fastener and for securing said weight elements to said extensions of said handle bar.

5. The adjustable dumbbell assembly as claimed in claim 1, wherein said blocks each include two cavities formed therein for engaging with said pair of beams.

6. The adjustable dumbbell assembly as claimed in claim 1, wherein said plates each include two orifices formed therein for engaging with said pair of beams.

7. The adjustable dumbbell assembly as claimed in claim 1, wherein said pair of beams each include a guide channel formed therein for slidably engaging with said rods respectively.

* * * * *